US005565710A

United States Patent [19]

Ochi et al.

[11] Patent Number: 5,565,710

[45] Date of Patent: Oct. 15, 1996

[54] PROCESS FOR MANUFACTURING GRANULAR IGNITER

[75] Inventors: Koji Ochi, Aichi-ken; Nobukazu Asano, Handa; Yoshio Sawada, Aichi-ken, all of Japan

[73] Assignee: NOF Corporation, Shibuya-ku, Japan

[21] Appl. No.: 377,712

[22] Filed: Jan. 23, 1995

[30] Foreign Application Priority Data

Jan. 24, 1994 [JP] Japan ..... 6-005953

[51] Int. Cl.[6] ..... C06B 21/00

[52] U.S. Cl. ..... 264/3.4; 264/3.6; 149/38; 149/111; 149/114

[58] Field of Search ..... 264/3.6, 3.4, 3.5; 149/38, 111, 114

[56] References Cited

U.S. PATENT DOCUMENTS

| | | | |
|---|---|---|---|
| H169 | 12/1986 | Mackenzie et al. | 149/19.3 |
| 2,774,660 | 12/1956 | Cook et al. | 71/64 |
| 2,931,067 | 4/1960 | Delaloye et al. | 18/47.2 |
| 3,716,315 | 2/1973 | King | 425/8 |
| 4,092,383 | 5/1978 | Reed, Jr. | 264/3 C |
| 4,597,994 | 7/1986 | Bolinder et al. | 427/213 |
| 4,764,329 | 8/1988 | Lerman | 264/3.5 |
| 4,925,600 | 5/1990 | Hommel et al. | 264/3.4 |
| 5,015,309 | 5/1991 | Wardle et al. | 149/19.1 |
| 5,034,070 | 7/1991 | Goetz et al. | 149/3 |
| 5,063,036 | 11/1991 | Engel et al. | 423/266 |
| 5,242,194 | 9/1993 | Popek | 280/737 |
| 5,263,740 | 11/1993 | Frey et al. | 280/737 |
| 5,290,060 | 3/1994 | Smith | 280/737 |
| 5,437,229 | 8/1995 | Taylor et al. | 102/288 |

FOREIGN PATENT DOCUMENTS

| | | |
|---|---|---|
| 3642850C1 | 2/1988 | Germany . |
| 3921098A1 | 1/1991 | Germany . |
| WO81/01704 | 6/1981 | WIPO . |

OTHER PUBLICATIONS

Chemical Engineer's Handbook, Perry and Chilton, 5TH Ed., 1973 pp. 20–55 to 20–63.

*Primary Examiner*—Charles T. Jordan
*Assistant Examiner*—John R. Hardee
*Attorney, Agent, or Firm*—Vidas, Arrett & Steinkraus

[57] ABSTRACT

There is provided a process for manufacturing a granular igniter, which facilitates control of the igniter preparation, handling of the granule igniter and improvement in manufacturized yield. The present invention also provides a process for manufacturing a granular igniter which is free from toxic gas generation when burned and which has excellent fluidity. The present invention moreover reduces the number of manufacturing process facilitating the production process, and reducing production costs.

An igniter containing boron and potassium nitrate are mixed together with water in a homogenizer to form a homogeneous slurry. The mixing ratio of the igniter to the water is set in the range of 1.0:0.6 to 1.0:1.6 in terms of weight ratio. The slurry is sprayed in a spray dryer where it is dried and granulated. Micropowder, which failed to be collected as the granule, is recovered through a cyclone, and recirculated as the raw material.

23 Claims, 1 Drawing Sheet

PROCESS FOR MANUFACTURING GRANULAR IGNITER

BACKGROUND OF THE INVENTION

1. Field of the Invention

The present invention relates to a process for manufacturing a granulated igniter used in a gas generator container. The gas generator container may be incorporated, for example, into an automotive air bag unit. The granular igniter functions to quickly and uniformly ignite a solid gas generator contained in the gas generator container.

2. Description of the Related Art

Boron niter as a boron and potassium nitrate compound is an igniter containing boron and potassium nitrate as major ingredients. Boron niter has excellent heat stability, burns quickly and generates a high calorific value. Another desirable characteristic of boron niter is its relatively stable burn rate in the presence of ambient pressure fluctuations. Due to these characteristics, boron niter has been used as an igniter for rocket propellants, and recently, as a constituent of a gas generator containers to inflate air bags. Most recently, the consumption of boron niter has drastically increased due to wide spread use of automobile air bags.

Because boron niter can be ignited by impact or friction, it has up to now been produced in a small amounts, e.g., of about 0.5 to 20 kg/batch, in order to prevent unintended ignition.

The following is a common method of manufacturing boron niter. First, in a mixing step, powdery raw materials such as boron, potassium nitrate, etc. are mixed, a binder component dissolved in an organic solvent is added to the mixture, and the entire mixture is then subjected to wet blending. The blended mixture is next granulated in a granulation step by passing it in wet form through a wire or silk netting. The granule obtained is then dried to evaporate the solvent, and in a final step, in which it is filtered, or as it is known, classified.

The prior art method described above, however, involves the following five problems.

First, the granulation step, according to previous manufacturing methods, is a step which must be carried out very carefully. If large amounts of the granule are granulated at the same time, the blended mixture may inadvertently explode. Moreover, previous methods of manufacturing boron niter often entailed an inordinate number of steps from mixing of raw materials to classification. As a result, boron niter production required the use of large-scale equipment to achieve full remote control of these steps. Thus, a tremendous investment had to made in the equipment necessary for boron niter's production. Moreover, a lot of labor was required for the maintenance and control of the equipment. Were the granule to be prepared in the absence of such large-scale equipment, workers would be forced to directly participate in the manufacturing operation. Due to the igniter's explosiveness, countermeasures would therefore have to be taken to ensure the safety of the workers.

Secondly, about 10 to 20% by weight of micropowder is typically formed during the classification step according to previous manufacturing methods. Since the fluidity of the final product is inhibited by the presence of micropowder, the micropowder must be removed by all means. Accordingly, the yield of the final product will be lowered.

Thirdly, about 1 to 10% by weight of an organic binder is required by previous manufacturing methods to improve granulating properties in the granulation step. When burned, however, the organic binder produces toxic gasses such as carbon monoxide and hydrogen fluoride. Thus, if such organic binder is incorporated into a gas generator container for an air bag, the driver and passengers in the cabin of an automobile would be subject to inhaling toxic gasses.

Fourthly, since the shape of the granules produced by previous manufacturing methods lack a spherical shape, the granules consequently lack fluidity. Accordingly, the gas generator containers and the like are manufactured with poor efficiency. Moreover, the apparent specific gravity of the granule significantly varies from lot to lot. Thus, if a fixed weight of boron niter is to be loaded in a gas generator container, the volume with which it occupies inevitably varies, forcing the volume of the boron niter to be adjusted lot by lot. This makes for an intricate and difficult assembly of the gas generator containers.

Finally, according to previous manufacturing methods, the large number of steps needed to produce the igniter results in increased igniter manufacturing costs.

SUMMARY OF THE INVENTION

Accordingly, it is a primary objective of the present invention to provide a process for manufacturing a granular igniter, which decreases the amount of maintenance needed during the igniter's manufacture, improves the control and handling of the igniter during its preparation and increases the yield of the final product.

It is another objective of the invention to provide a process for manufacturing a granular igniter, which decreases the amounts of toxic gasses produced when the granular igniter is burned and which provides a granular igniter having improved fluidity.

It is another objective of the invention to provide a process for manufacturing a granular igniter, having a reduced number of manufacturing steps from that of previous methods in order to facilitate igniter preparation and to lower its manufacturing cost.

In order to accomplish these and other objects of the present invention, a process for manufacturing granular igniter comprising:

- a first process for forming a slurry by mixing an igniter material with a solvent, said igniter material including a reducing agent and a oxidizing agent; and
- a second process for spraying the slurry in the form of droplets under a heated atmosphere, wherein said granular igniter is obtainable by drying the droplets.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiment taken in conjunction with the accompanying drawing in which:

DETAILED DESCRIPTION OF THE PREFERRED EMBODIMENTS

Figure 1:
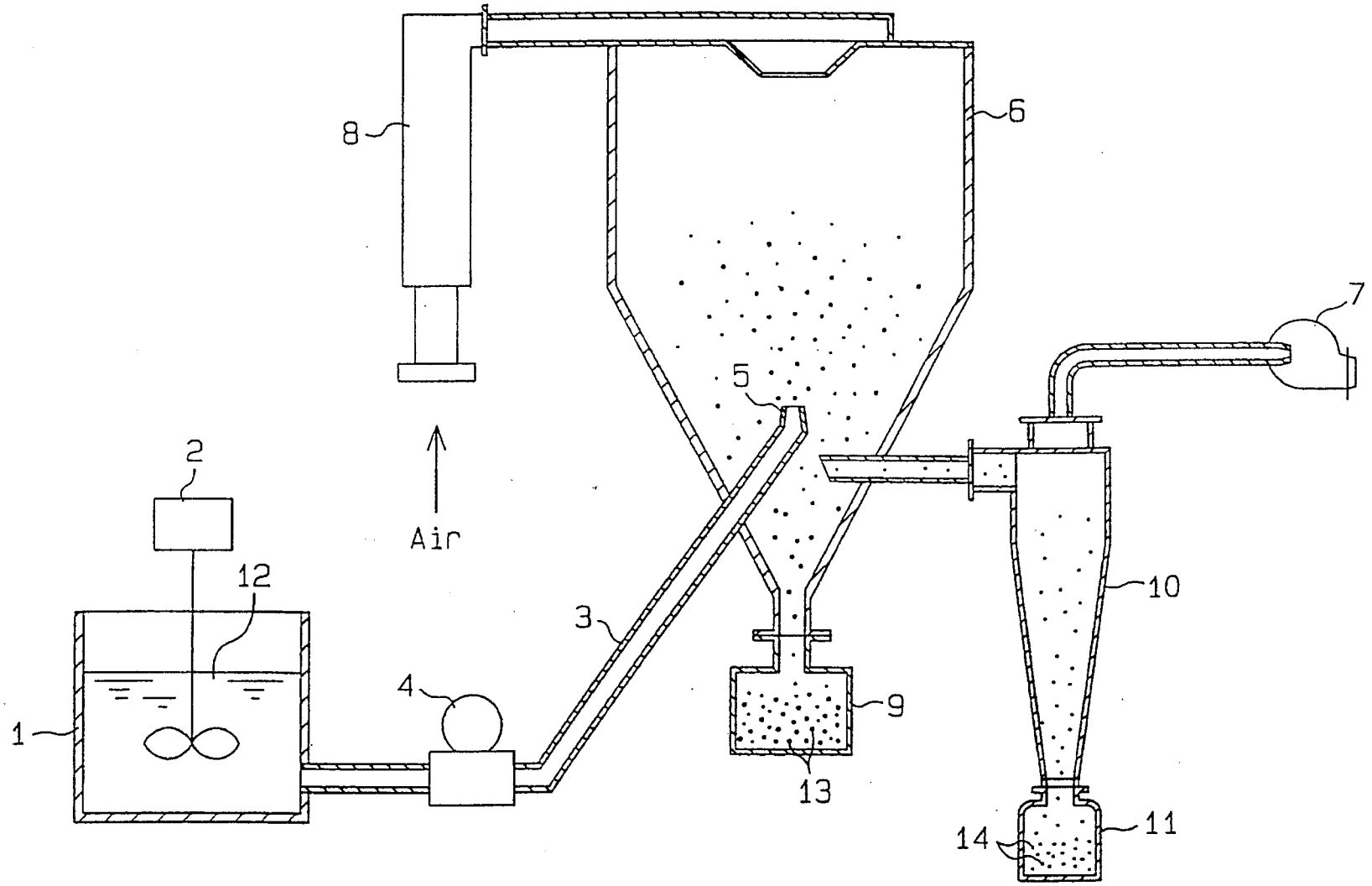
FIG. 1 is a schematic cross-sectional view of the process for producing a granular igniter according to the embodiment of the invention.

The process for manufacturing igniter granules will now be described.

First, the raw material ingredients used to manufacture igniter granules contain no substantial amount of organic binder. For example, the raw material ingredients contain a mixture of boron and potassium nitrate or a mixture of magnesium, polytetrafluoroethylene and an inorganic binder.

Boron, which is a reducing agent, can be mixed with an oxidizing agent such as potassium nitrate at an appropriate ratio to form a composition having excellent performance as the igniter. The boron would preferably have an average particle size of 0.1 to 10 μm, and more preferably 0.5 to 1.5 μm. The average particle sizes less than 0.1 μm, create difficulties in the manufacturing process and ultimately increase manufacturing costs. The average particle sizes in excess of 10 μm, on the other hand, lower the combustion rate of the igniter.

The structure of the boron is according to the present invention preferably amorphous. The boron, moreover has a specific surface area of 1 to 50 $m^2/g$. Surface areas of less than 1 $m^2/g$ result in a decrease in the igniter's combustion rate; whereas surface areas in excess of 50 $m^2/g$, overly complicate the manufacturing process and result in excessive manufacturing costs.

Potassium nitrate, which is a typical oxidizing agent, can be mixed with boron at an appropriate ratio to form a composition having excellent performance as an igniter. The average particle size of the potassium nitrate should be 100 μm or less, and more preferably 20 μm or less. The average particle sizes in excess of 100 μm make it difficult to achieve uniform and fine granulation in the spray drying step.

The preferable weight ratio of boron to potassium nitrate is in the range of 1:1 to 1:9. A weight ratio not in this range will reduce the combustion rate of the igniter. Additives such as a binder component, a lubricant, etc. can, as necessary, be added in small amounts to boron and potassium nitrate.

Meanwhile, when a mixture of magnesium, polytetrafluoroethylene and an inorganic binder is used as the igniter, the weight ration of magnesium to polytetrafluoroethylene should desirably be in the range of 7:3 to 3:7. For the inorganic binder, a colloidal silica and the like can be used. The content of the inorganic binder in the igniter is preferably in the range of 1 to 10% by weight. If the amount of the inorganic binder to be admixed is less than 1% by weight, the binder will not exhibit sufficient binding. If the amount of the inorganic binder exceeds 10% by weight, the performance as the igniter will be lowered.

Additional the components which can be incorporated with the igniter components may include a plasticizer, a lubricant such as a stearic acid salt and graphite; and a slurry dispersant and antifoamer, when a spray dryer is employed. The spray dryer is an apparatus for spraying and drying a slurry (to be described later) so as to obtain a granule.

Next, according to the process for manufacturing a granular igniter of the present invention, the above-described igniter is mixed with an aqueous medium and made into a slurry. The slurry is then subjected to spraying and drying under predetermined conditions to be made into a granule. As the solvent used in this process, water, a chlorine-containing solvent, acetone, etc. can be used. Chlorine-containing solvent, acetone, etc. on the other hand present handling problem and tend to decrease the desirable physical properties of the granule. For this reason, water is the most suitable aqueous medium. A homogenizer and the like is used as a means to form the slurry. The homogenizer is provided with a high speed turbine and a stirring section having a radial blocking member. The turbine rotates at a high speed along the inner periphery of the radial blocking member. The homogenizer in this embodiment is presented as a working example. It will be understood by the skilled in the art that any preferable kind of homogenizers is able to be utilized. A homogeneous slurry is prepared by the strong shear force, impact or turbulence generated by the high-speed rotation of the turbine.

More specifically, at first boron, potassium nitrate and water, and then powder components including additives etc. are, as necessary, homogeneously mixed to form a slurry by the homogenizer. While a tap water may be used here as the water, a deionized water, more preferably a distilled water is used to minimize the impurity content in the final product.

The homogeneously mixed slurry is subjected to spraying, drying and granulation at substantially the same time. All these steps can be achieved by spraying the igniter slurry in the form of droplets to a drying tower into which a hot air is blown. In this step, an apparatus generally called spray dryer can suitably be employed, and an igniter granule can easily be obtained.

The methods used to produce droplets from the slurry can be of two types: a rotary disc method, and a nozzle method. Where a highly combustible igniter is subject to spraying, drying and granulation, as in the current invention, the nozzle method is preferred since it does not involve a frictional sliding member in the section where granulation occurs. While there are various kinds of nozzles, any of a two-fluid nozzle, a pressurized nozzle and a pressurized two-fluid nozzle can be employed.

In the above-described spraying, drying and granulation step, the ratio of the igniter to the aqueous medium in the slurry, i.e., the proportion of water in the slurry, is significant with respect to several points as mentioned below.

First, the maximum amount of granule prepared per unit time in the spray-drying granulation step is decided by the amount of water to be fed into the drying tower per unit time. This directly affects manufacturing efficiency provided that the drying performance of the tower is fixed. The smaller the proportion of water in the slurry is, the more granules can be produced. Accordingly, a smaller proportion of water in the slurry is preferred since it increases manufacturing efficiency.

Secondly, the larger the granule diameter can be made by spraying, drying and granulation, the higher its apparent specific gravity will be. The same is true with respect to granule fluidity. In order to obtain granules with large grain sizes, generally the proportion of water in the slurry should be small.

Thirdly, the strength of the granule depends on the binding force of the potassium nitrate, which is present in the dissolved slurry and which recrystallizes in the spraying, granulation and drying step. More specifically, the greater the amount of the igniter component dissolved in the slurry is, i.e. the greater the proportion of water in the slurry is, the more preferred it is.

It is obvious from these three points, however, that different preferences result from the various amounts of water used in the slurry. Smaller amounts of water in the slurry result in increased manufacturing efficiency and larger granule grain sizes. Increased amounts of water result in stronger granules. Thus, when these requirements are comprehensively reviewed, the ratio of the solid to water in the slurry should preferably be in the range of 100:60 to 100:140, more preferably in the range of 100:80 to 100:100, in terms of weight ratio.

As a technique of solving the third problem described above based on the condition where the proportion of water in the slurry is set to a low level, the following method is suited. Before subjected to spray-drying and granulation, the slurry should be preliminarily heated to 40° to 80° C.

The solubility of potassium nitrate in water increases as the temperature of water rises. For example, it is 11.7% at 0° C., 39.0% at 40° C. and 62.8% at 80° C. Accordingly, even when the proportion of water in the slurry is small, potassium nitrate can be dissolved in a greater amount as the water temperature rises, exhibiting an increased binding force when it is recrystallized at spraying, drying and granulation. Thus, strength of the granule can be enhanced. However, if the water temperature is too high, countermeasures need to be taken to prevent evaporation of the water during the preparation steps. A suitable water temperature, for example, is from 40° C. to 80° C.

The process for manufacturing the granule will now be described referring to the attached drawing.

FIG. 1 is a schematic cross-sectional view of a granulating apparatus that uses spray drying according to one embodiment of the present invention.

In a stock solution tank 1, predetermined amounts of boron and potassium nitrate as the igniter components are homogeneously mixed with a predetermined amount of deionized water as the aqueous medium by a stirrer 2 to form a raw material slurry 12. The raw material slurry 12 is fed through a liquid feeding pipe 3 by a metering pump 4 disposed in the pipe 3 and is then sprayed through a nozzle 5, provided at the tip of the pipe 3, into a drying tower 6. More specifically, the raw material slurry 12 is finely atomized into droplets by the nozzle 5, and sprayed in an upward direction in the drying tower 6.

Meanwhile, a fresh air is blown into the drying tower 6 through a heat exchanger 8 under the action of an exhauster 7. The air to be blown into the tower 6 is preliminarily heated by the heat exchanger 8 from 150° C. to 250° C. Accordingly, the droplets sprayed from the nozzle 5 contact the hot air while in the drying tower 6, dry into a granular igniter 13, and collect into a collector 9. Drying time takes one to ten seconds from the point that the droplets are sprayed from the nozzle 5 until the granules collect in the collector 9.

The grain size of boron niter to be prepared according to this method is substantially dependent on the particle size of the droplets to be obtained by finely dividing the slurry 12 by the nozzle 5. The particle size of the droplets depends on the physical properties of the slurry 12, the slurry feed amount per unit time, the shape of the nozzle 5, the spraying method, etc. The particle size of the granular igniter 13 to be obtained according to such method is in a range from 50 to 500 micrometers, preferably in a range from 50 to 300 micrometers.

The granule has a substantially spherical shape. Accordingly, the granule is allowing for excellent granule fluidity and bulk density of the granule is constant. This enables the granular igniter 13 to be easily incorporated into a gas generator container.

The micropowder 14 which is finer than the granule 13 formed in the above granulation step is recovered through a cyclone 10 into a recovered powder container 11 provided at the bottom of the cyclone 10. The recovered micropowder 14 is recirculated to be made into a slurry. The recovery step attached here serves to achieve a substantial closed system yield of about 100% including the recycle of the micropowder 14.

An embodiment of the invention will be described by way of Examples in comparison with Comparative Example.

It should be noted here that, in the following Examples and Comparative Example, % by weight is simply represented by %. The spray dryer employed in the following Examples is a dryer manufactured under the trade name Spraydryer Model LT-8 by Ohkawara Kakoki Kabushiki-Kaisha. This spray dryer is of the same constitution as shown in FIG. 1, and the nozzle used here is a two-liquid nozzle which finely divides the slurry with the aid of compressed air. The temperature at the hot air blowing inlet of the drying tower of the spray dryer was set to a constant level of 200°±2° C. The weight ratio of boron to potassium nitrate in the boron niter was set to a constant level of 25:75.

EXAMPLES 1 and 2

After a predetermined amount of deionized water was metered, the water was charged into a container together with boron and potassium nitrate, wherein the ratio of the total solid content of boron and potassium nitrate to the liquid content was preliminarily adjusted as shown in Table 1. The resulting mixture was stirred and blended by a homogenizer to form a homogeneous slurry 12. Subsequently, the slurry 12 was subjected to spraying, drying and granulation in the spray dryer.

The recovery (%) of the granule collected in the collector 9 was as shown in Table 1. The greater part of the uncollected portion was recovered as a micropowder 14 into the cyclone 10.

The granules 13 collected were measured for the average grain size (μm) using a grain size measuring apparatus produced under the trade name "Gilsonic Autoceiver", by Seishin Kigyo Kabushiki-Kaisha to obtain the results as shown in Table 1. The granules 13 all showed excellent fluidity.

Further, in order to measure the water content (%) in each granule 13, weight loss in the granule 13 after four hours of heating at 105° C., was measured to obtain the values as shown in Table 1.

EXAMPLES 3 and 4

Spraying, drying and granulation were carried out in the same manner as in Example 1 except that the solid-to-liquid ratio in the slurry and the slurry temperature were changed, as shown in Table 1. The granules 13 thus obtained were evaluated in the same manner as in Example 1, and the results are as shown in Table 1.

EXAMPLE 5

After a predetermined amount of deionized water was metered, the water was charged into a container together with the micropowder 14 recovered into the cyclone 10. The ratio of the total solid content of boron and potassium nitrate to the liquid content was preliminarily adjusted as shown in Table 1. The resulting mixture was stirred and blended by a homogenizer to form a homogeneous slurry 12. Subsequently, the slurry 12 was subjected to spraying, drying and granulation in the spray dryer.

In Table 1, the boron used was the type produced under the trade name, "An Amorphous Boron Grade 2" by Starck-VTECH Ltd. while the type of potassium nitrate used was Shoseki Special produced by Katayama Kagaku-Kogyo Kabushiki-Kaisha.

EXAMPLES 6 to 8

Tests were carried out in the same manner as in Example 1 using low-liquid content slurries (Examples 6 and 7) and a high-liquid content slurry (Example 8). Recovery (%), average grain size, fluidity and water content of each granule 13 were determined. The results are also shown in Table 1.

TABLE 1

| | Solid-to-liquid ratio in slurry (slid/liquid) | Slurry temperature (°C.) | Recovery (%) | Average grain size (μm) | Fluidity | Water content (%) |
|---|---|---|---|---|---|---|
| Example 1 | 1.0/1.2 | 21 | 75 | 76 | Good | 0.6 |
| Example 2 | 1.0/1.4 | 22 | 71 | 76 | Good | 0.9 |
| Example 3 | 1.0/1.0 | 40 | 80 | 87 | Good | 0.2 |
| Example 4 | 1.0/1.0 | 61 | 86 | 90 | Good | 0.1 |
| Example 5 | 1.0/1.2 | 21 | 72 | 72 | Good | 0.5 |
| Example 6 | 1.0/0.7 | 22 | 79 | 90 | Good | 0.3 |
| Example 7 | 1.0/0.6 | 21 | 62 | 93 | Good | 0.2 |
| Example 8 | 1.0/1.6 | 22 | 60 | 61 | Medio-cre | 1.3 |

As shown in The Table 1, boron niter having excellent fluidity can be obtained according to the preparation method of Example 1 or 2.

According to the preparation method of Example 3 or 4, a granule having excellent fluidity can be obtained if the slurry temperature is raised from 40° C. to 61° C. even under the condition where the proportion of water in the slurry is small.

As demonstrated in Example 5, since no organic binder is used as the raw material, the micropowder recovered by the cyclone can again be made into a slurry. The micropowder recovered and made again into a slurry is then subjected to spraying, drying and granulation to give a granule having a desired fluidity. Accordingly, the percentage of the granule recovered by weight in the closed system is approximately 100%.

As demonstrated in Example 6 or 7, a granule which can show excellent fluidity at room temperature can be obtained even when the proportion of water in the slurry is very small (solid/liquid=1.0/0.7 or 1.0/0.6). As the results of Example 8 demonstrate, granules can be produced having good fluidity without degrading the efficiency with which they are produced, even using large amounts of water (solid/liquid=1.0/1.6).

Since a spray dryer was employed as a spraying dryer and granulating apparatus in each Example, the spray dryer can be remote-controlled. Accordingly, if the granule should inadvertently be ignited, the safety of the workers can be ensured. Besides, since no organic binder is required, toxic gas generation during granule combustion is not present.

Further, the physical properties (of the slurry), the spraying conditions, etc. can mechanically be controlled according to the process for manufacturing a granule in each Example. Variations in the quality of the product produced from lot to lot can be reduced.

In addition, according to the manufacturing process of the present invention, the preparation steps can be simplified, enabling mass production and allowing for a reduction in production costs.

EXAMPLE 9

The calorific value of the granule obtained in Example 1 was measured three times under the same conditions using an automatic bomb (calorimeter) produced under the trade mark Calorimeter CA-4P by Shimadzu Corporation. This Calorimeter can automatically determine the calorific value by measuring the temperature rise in the ambient water by the heat generated when a sample is burned in a closed vessel, and the calorific value data thus measured are shown in Table 2.

The gas generated by burning the sample was collected to measure hydrogen fluoride concentration using a Kitagawa's gas detection tube, with the results as shown in Table 2.

Comparative Example 1

The same boron and potassium nitrate as in Example 1 were used as the raw materials to prepare boron niter according to the prior art manufacturing method.

A mixture containing 25% of boron and 75% of potassium nitrate was blended in a rolling mill for a predetermined time, and then a binder trademarked "Viton" (trade name), by Du Pont-Showa Denko Co., Ltd., dissolved in acetone, was added thereto. The resulting mixture was granulated by passing it through a 32-mesh standard sieve in an appropriate wet form. The granule obtained was air-dried for 48 hours and then subjected to classification between 32 to 100 mesh to provide a sample.

The sample was evaluated in the same manner as in Example 9, and the results are as shown in Table 2.

TABLE 2

| | Calorific value (cal/g) | Hydrogen fluoride concentration (ppm) |
|---|---|---|
| Example 9 | 1492 | Undetected |
| | 1460 | Undetected |
| | 1478 | Undetected |
| Comparative Example 1 | 1455 | 2.0 |
| | 1397 | 0.7 |
| | 1312 | 1.5 |

As shown in Table 2, the boron niter obtained according to the manufacturing process of Example 9 showed a consistent performance and was free from toxic gas generation. On the other hand, the boron niter obtained in Comparative Example 1 according to the prior art manufacturing method showed inconsistent performance and generated toxic gas.

Although only one embodiment of the present invention has been described herein, it should be apparent to those skilled in the art that the present invention may be embodied in many other specific forms without departing from the spirit or scope of the invention. Particularly, it should be understood that the following modes may be applied.

(1) The micropowder 14 recovery process using the cyclone 10, as shown in FIG. 1 may be omitted. In this case, removal of the micropowder from the dryer 6 still must be performed, however, the micropowder need not be separately collected after its removal from the dryer 6. With the recovery process omitted, substantially the same results are provided in the present invention as were explained in previous embodiments. Specifically, smooth igniter burn rates, high degrees of fluidity and grain size, and low manufacturing costs may be obtained with a simplified structure.

Therefore, the present examples and embodiment are to be considered as illustrative and not restrictive, and the invention is not to be limited to the details given herein, but may be modified within the scope of the appended claims.

What is claimed is:

1. A method for manufacturing granular igniter comprising:

a) forming a slurry by mixing an igniter material with an aqueous medium, said igniter material including a mixture of boron and potassium nitrate, in a weight ratio of said igniter material to the aqueous medium in a range from 100 to 60 to 100 to 140 by weight;

b) spraying the slurry in the form of droplets under a heated atmosphere in a spray dryer to obtain crude granular igniter;

c) subjecting said crude granular igniter to separation process by means of a cyclone cylinder to provide a first group of granular igniter and a second group of micropowder, the separated micropowder of said second group having an average diameter smaller than about 50 micrometers; and d) recycling the micropowder separated in step c by mixing it with the slurry of step a.

2. The method as set forth in claim 1 wherein said boron has an average grain size in a range from 0.1 to 10 micrometers.

3. The method as set forth in claim 2 wherein said boron is amorphous and has a specific surface area in a range from 1 to 50 $m^2/g$.

4. The method as set forth in claim 2 wherein said potassium nitrate has an average grain size of at most 100 micrometers.

5. The method as set forth in claim 4 wherein a weight ratio of boron to potassium nitrate is in a range from 1:1 to 1:9.

6. The method as set forth in claim 5 wherein said slurry is homogeneously formed by a homogenizer having a high speed turbine.

7. The method as set forth in claim 6 further including a step for heating the slurry from 40° C. to 80° C. before the spraying operation.

8. The method as set forth in claim 7 wherein the slurry is sprayed through a nozzle.

9. The method as set forth in claim 8 wherein the slurry is sprayed upward through a nozzle.

10. The method as set forth in claim 9 wherein said aqueous medium is water.

11. The method as set forth in claim 10 wherein said water is ion-exchanged water or distilled water.

12. The method as set forth in claim 5 wherein said igniter material further includes at least one agent selected from the group consisting of plasticizer, lubricant, slurry dispersant and antifoamer.

13. A method for manufacturing granular igniter comprising:

a) forming a slurry by mixing an igniter material with an aqueous medium, said igniter material including of mixture consisting of boron and potassium nitrate, in a weight ratio of said igniter material to the aqueous medium in a range from 100:60 to 100:140 by weight;

b) spraying the slurry in the form of droplets under a heated atmosphere to obtain crude granular igniter;

c) subjecting said crude granular igniter to separation process by means of a cyclone cylinder to provide a first group of granular igniter and a second group of micropowder, the separated micropowder of said second group having an average diameter smaller than about 50 micrometers; and d) recycling the micropowder separated in step c by mixing it with the slurry of step a.

14. A method for manufacturing granular igniter comprising:

a) forming a slurry by mixing an igniter material with an aqueous medium, said igniter material including a mixture of magnesium and polytetrafluoroethylene both bound to each other by an inorganic binder, in a weight ratio of said igniter material to the aqueous medium in a range from 100 to 60 to about 100 to 140 by weight, a weight ratio of magnesium to polytetrafluoroethylene in a range from 7 to 3 to about 3 to 7;

b) spraying the slurry in the form of droplets under a heated atmosphere in a spray dryer to obtain crude granular igniter;

c) subjecting said crude granular igniter to separation process by means of a cyclone cylinder to provide a first group of granular igniter and a second group of micropowder, the separated micropowder of said second group having an average diameter smaller than about 50 micrometers; and d) recycling the micropowder separated in step c by mixing it with the slurry of step a.

15. The method as set forth in claim 14 wherein said inorganic binder is a colloidal silica and the content of the colloidal silica in the igniter material is in a range from 1 to 10% by weight.

16. The method as set forth in claim 15 wherein said slurry is homogeneously formed by a homogenizer having a high speed turbine.

17. The method as set forth in claim 16, further including a step for heating the slurry from 40° C. to 80° C. before the spraying operation.

18. The method as set forth in claim 17 wherein the slurry is sprayed through a nozzle.

19. The method as set forth in claim 18 wherein the slurry is sprayed upward through a nozzle.

20. The method as set forth in claim 19, wherein said aqueous medium is water.

21. The method as set forth in claim 20 wherein said water is ion-exchanged water or distilled water.

22. The method as set forth in claim 15 wherein said igniter material further includes at least one agent selected from the group consisting of plasticizer, lubricant, slurry dispersant and antifoamer.

23. A method for manufacturing granular igniter comprising:

a) forming a slurry by mixing an igniter material with an aqueous medium, said igniter material including a mixture consisting of magnesium and polytetrafluoroethylene both bound to each other by an inorganic binder, in a weight ratio of said igniter material to the aqueous medium in a range from 100:60 to 100:140 by weight, a weight ratio of magnesium to polytetrafluoroethylene in a range from 7:3 to 3:7;

b) spraying the slurry in the form of droplets under a heated atmosphere to obtain crude granular igniter;

c) subjecting said crude granular igniter to separation process by means of a cyclone cylinder to provide a first group of granular igniter and a second group of micropowder, the separated micropowder of said second group having an average diameter smaller than about 50 micrometers; and d) recycling the micropowder separated in step c by mixing it with the slurry of step a.

* * * * *